US007100912B2

(12) United States Patent
Yun

(10) Patent No.: US 7,100,912 B2
(45) Date of Patent: Sep. 5, 2006

(54) PAPER FEEDING APPARATUS FOR A PRINTER

(75) Inventor: Seuk-jin Yun, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 185 days.

(21) Appl. No.: 10/439,177

(22) Filed: May 16, 2003

(65) Prior Publication Data

US 2003/0227124 A1 Dec. 11, 2003

(30) Foreign Application Priority Data

Jun. 11, 2002 (KR) ..... 10-2002-0032519

(51) Int. Cl.
*B65H 5/00* (2006.01)

(52) U.S. Cl. ..... 271/10.11; 271/117; 271/118

(58) Field of Classification Search ..... 271/10.11, 271/114, 117, 118, 273
See application file for complete search history.

(56) References Cited

U.S. PATENT DOCUMENTS 3,195,885 A * 7/1965 Rowell, Sr. ..... 271/10.04
3,411,768 A * 11/1968 Gatti ..... 271/10.09
3,885,782 A * 5/1975 Wright et al. ..... 271/10.05
4,387,889 A * 6/1983 Koyama et al. ..... 271/10.01
5,181,708 A * 1/1993 Ruch ..... 271/21
5,419,543 A * 5/1995 Nakamura et al. ..... 271/9.01
5,882,003 A * 3/1999 Fujiwara et al. ..... 271/10.11
6,000,689 A * 12/1999 Furuki et al. ..... 271/10.11
6,161,829 A * 12/2000 Kusumi ..... 271/9.05
6,260,840 B1 * 7/2001 Suga et al. ..... 271/10.12
6,375,183 B1 * 4/2002 Inoue et al. ..... 271/10.11
6,540,220 B1 * 4/2003 Kuo et al. ..... 271/118

FOREIGN PATENT DOCUMENTS

| | | | |
|---|---|---|---|
| EP | 0606741 | * | 7/1994 |
| JP | 52-32400 | * | 3/1977 |
| JP | 53-74433 | * | 7/1978 |
| JP | 57-85737 | * | 5/1982 |
| JP | 63-147729 | * | 6/1988 |
| JP | 4-286553 | * | 10/1992 |
| JP | 5-32356 | * | 2/1993 |
| JP | 9-194068 | | 7/1997 |

* cited by examiner

*Primary Examiner*—Kathy Matecki
*Assistant Examiner*—Thomas Morrison
(74) *Attorney, Agent, or Firm*—Staas & Halsey LLP

(57) ABSTRACT

Provided a paper feeding apparatus used with a printer includes a pickup roller which draws out a paper stacked in a cassette and conveys the paper to a printer, a conveying roller which conveys the drawn-out paper onto a paper feeding route, and a feeding roller which feeds the paper conveyed by the conveying roller to a printing portion. The conveying roller is driven when the paper supplied by the pickup roller is conveyed to the feeding roller, and after the paper is conveyed to the feeding roller, the conveying roller is isolated from the paper feeding route.

5 Claims, 5 Drawing Sheets

PAPER FEEDING APPARATUS FOR A PRINTER

CROSS-REFERENCE TO RELATED APPLICATIONS

This application claims the benefit of Korean Application No. 2002-32519, filed Jun. 11, 2002, in the Korean Intellectual Property Office, the disclosure of which is incorporated herein by reference.

BACKGROUND OF THE INVENTION

1. Field of the Invention

The present invention relates to a paper feeding apparatus used with a printer, which draws out one sheet of paper at a time from a paper stacked on a tray and supplies one sheet of paper at a time to the printer, and more particularly, to a paper feeding apparatus used with a printer, having a conveying roller to supply a sheet of paper from a pickup roller to a feeding roller, the conveying roller being detachable from a paper feeding route according to a rotation direction of the pickup roller.

2. Description of the Related Art

In general, a paper feeding apparatus to sequentially supply a plurality of sheets of paper is provided in a printer, a copier, and a facsimile.

FIG. 1 is a cross-sectional view illustrating main portions of a conventional paper feeding apparatus for a printer. Referring to FIG. 1, an ink-jet printer 10 includes a paper feeding portion 20, a conveying portion 40, a printing portion 60, and a paper exhausting portion 80.

The paper feeding portion 20 supplies a sheet of paper P to a printer. The paper feeding portion 20 includes a paper feeding cassette 21 movably installed at a lower side of the ink-jet printer 10 so that the paper P to be printed is stacked in the paper feeding cassette 21, and a pickup roller 24 installed at an upper side of the paper feeding cassette 21, so that a sheet of the paper P stacked in the paper feeding cassette 21 is supplied at a time to the printer 10.

A driving unit (not shown) actuates the pickup roller 24 via a gear train 26, causing the pickup roller 24 to consecutively draw out sheets of the paper P. The pickup roller 24 is connected to a support arm 25 and contacts the paper P due to its weight. Also, the outer surface of the pickup roller 24 is surrounded by a friction part 24*a* having a comparatively large friction coefficient so that the pickup roller 24 easily draws out sheets of the paper P. Preferably, the friction part 24*a* is formed of rubber.

The conveying portion 40 guides the paper P supplied to the printer 10 by the paper feeding portion 20, to be conveyed to the printing portion 60. For this purpose, the conveying portion 40 includes a conveying roller 41 which conveys the paper P supplied by the paper feeding portion 20, a guide 43 which guides the paper P to be conveyed to the printing portion 60, and a feeding roller 45 which conveys the paper P to the printing portion 60.

The printing portion 60 performs a printing operation onto the conveyed paper P. The printing portion 60 allows a carriage 61, in which an ink cartridge 63 is installed, to perform an alternating rectilinear motion driven by a driving unit (not shown), and the printing portion 60 performs a printing operation onto the paper P via a printhead 65.

The paper exhausting portion 80 includes a paper exhausting roller 81 which withdraws the printed paper P from the printing portion 60 and stacks the paper P on a paper exhausting stand (not shown).

Since the conveying roller is additionally installed between the pickup roller and the feeding roller, the paper feeding apparatus having the above structure is useful when the size of a printing medium is small.

However, when the conveying roller continuously rotates in a paper feeding route as described above, a new problem occurs. That is, if the paper passing the conveying roller meets the feeding roller, one side of the paper contacts the feeding roller, and the other side of the paper is progressed for a predetermined amount of time such that the paper is aligned in front of the feeding roller. In this case, paper curl occurs between the driving conveying roller and the stopped feeding roller. Subsequently, the paper is fed by a rotation force of the feeding roller and the conveying roller, and thereby a printing operation is performed. In general, a feeding force of the feeding roller is greater than an exhausting force of the conveying roller. When the paper is fed to the printing portion in a state where the paper is engaged with the conveying roller, paper curl is maintained at a constant level, and a printing operation is performed in this state. However, at an instant when the paper escapes from the conveying roller which applies a predetermined force to the paper, the force applied to the paper is varied, causing a variation in a feeding rate. As a result, a white background appears on the printed side of the paper, and printing quality is lowered.

SUMMARY OF THE INVENTION

The present invention provides a paper feeding apparatus used with a printer, wherein when a paper is supplied onto a printing route by a feeding roller, a conveying roller is isolated from the paper, thereby applying a predetermined force during a printing operation.

Additional aspects advantages of the invention will be set forth in part in the description which follows and, in part, will be obvious from the description, or may be learned by practice of the invention.

The foregoing and/or other objects of the present invention are achieved by providing a paper feeding apparatus used with a printer, the paper feeding apparatus comprising: a pickup roller which draws out a paper stacked in a cassette and conveys the paper to a printer, a conveying roller to convey the drawn-out paper onto a paper feeding route, and a feeding roller to feed the paper conveyed by the conveying roller to a printing portion, wherein the conveying roller is driven when the paper supplied by the pickup roller is conveyed to the feeding roller, and after the paper is conveyed to the feeding roller, the conveying roller is isolated from the paper feeding route.

In an aspect of the present invention, the conveying roller contacts the paper feeding route by a contact with the pickup roller when the pickup roller goes up, and the conveying roller is isolated from the paper feeding route due to its weight when the pickup roller goes down.

In another aspect of the present invention, the conveying roller is contacted by the pickup roller when the pickup roller rotates in a direction opposite to a paper feeding direction, and the conveying roller is isolated from the paper feeding route when the pickup roller rotates in the same direction as the paper feeding direction.

In yet another aspect of the present invention, the paper feeding apparatus further includes a driving gear connected to one end of a driving shaft to drive the pickup roller, a pickup roller gear which rotates by the driving gear in a direction opposite to a rotation direction of the driving gear, and a gear train housing in which the gears are provided.

In still another aspect of the present invention, a compressing unit rotates the driving gear so that one side of the driving gear is closely adhered to an inside of the gear train housing, thereby generating a predetermined friction force in a longitudinal direction of the driving shaft between the gear train housing and one side of the driving gear.

In still another aspect of the present invention, the compressing unit is a compression spring, one end of which is fixed in the driving shaft and the other end thereof is closely adhered to another side of the driving gear such that an elastic force acts in a longitudinal direction of the driving shaft.

In still another aspect of the present invention, the paper feeding apparatus further includes an internal guide having a long slit in which a shaft of the conveying roller is moved so that the conveying roller is guided to be closely adhered to or detached from the paper feeding route.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
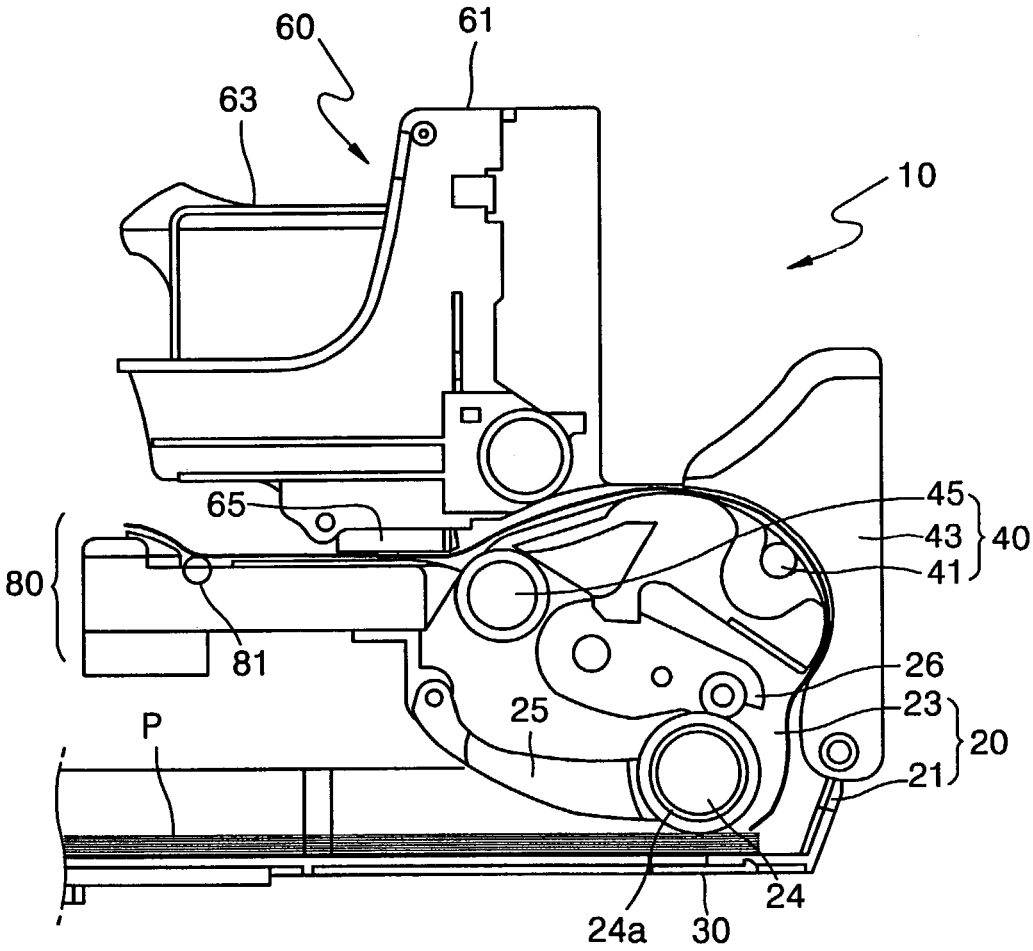
FIG. 1 (PRIOR ART)
FIG. 1 illustrates a printer adopting a conventional paper feeding apparatus.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
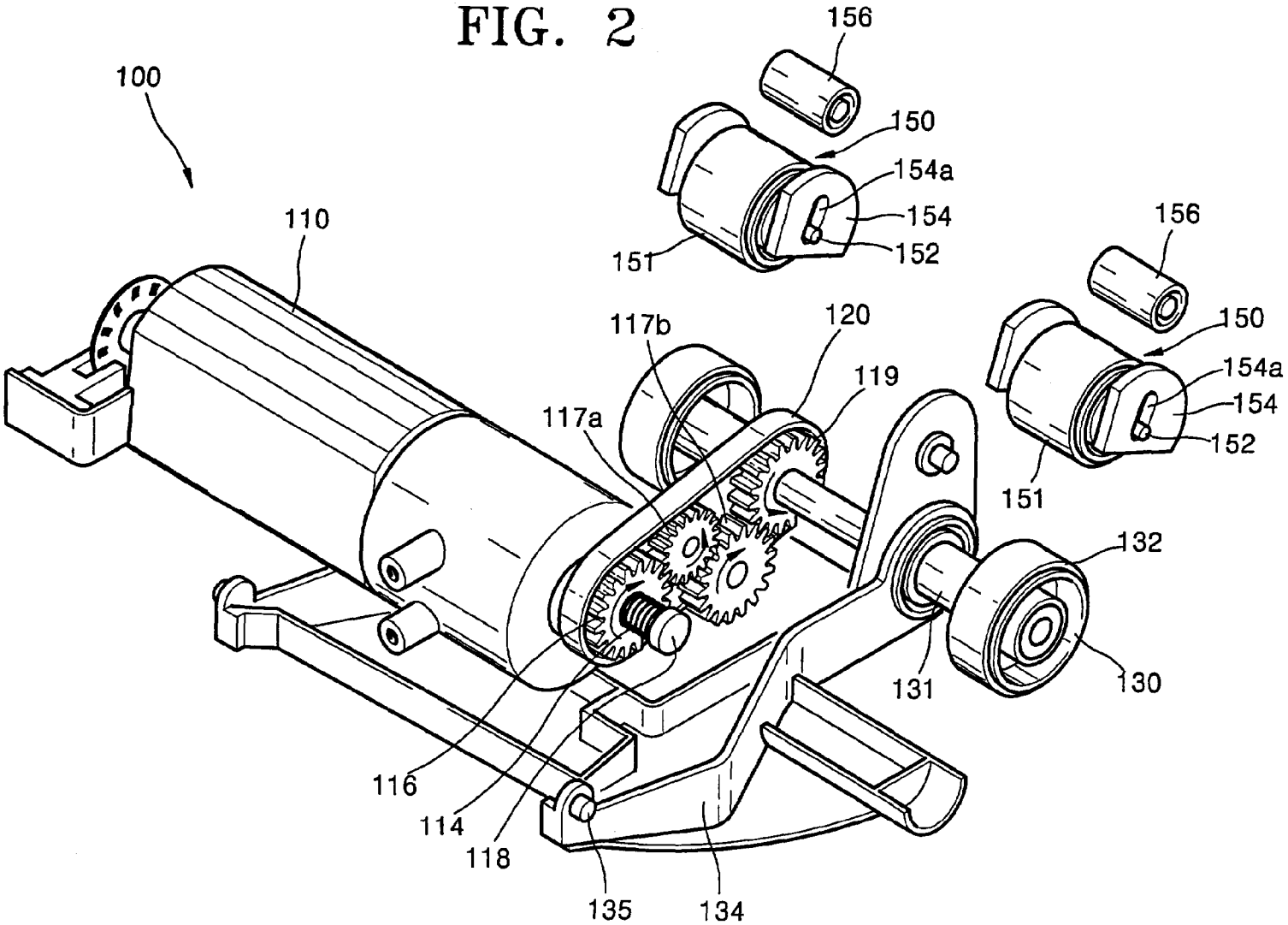
FIG. 2 is a partial perspective view illustrating a paper feeding apparatus used with a printer according to an embodiment of the present invention.

FIG. 2 is a partial perspective view illustrating a paper feeding apparatus used with a printer according to an embodiment of the present invention, in which a gear train housing 120 is opened. Referring to FIG. 2, a paper feeding apparatus 100 includes a pickup roller 130, which draws out a sheet of paper stacked in a cassette (not shown) and conveys the paper to a printer, a conveying roller 150 which conveys the drawn-out paper to a paper feeding route, and a feeding roller (145 of FIG. 4A) which feeds the paper conveyed by the conveying roller 150 to a printing portion. The pickup roller 130 is connected to a pickup roller gear 119, which rotates in a direction opposite to a rotation direction of a driving gear 116, and rotates by rotation of the driving gear 116 connected to the pickup roller gear 119 via two relay gears 117*a* and 117*b*. The gears 116, 117*a*, 117*b*, and 119 are placed in the gear train housing 120. The gears 116, 117*a*, 117*b*, and 119 and the gear train housing 120 are connected to a driving shaft (112 of FIG. 3) and pivot centering on the driving shaft 112. Meanwhile, the pickup roller 130 is connected to a support arm 134, which supports a shaft 131 to connect the pickup roller 130 to the pickup roller gear 119, and pivots centering on a pivot axis 135 fixed in the printer according to pivoting of the gears 116, 117*a*, 117*b* and 119, and the gear train housing 120. Reference numeral 110 denotes a driving motor, which rotates the driving shaft 112 and the driving gear 116.

The circumference of the pickup roller 130 is surrounded by a friction member 132, for example, elastic rubber, and the conveying roller 150 corresponding to the pickup roller 130 is provided above the pickup roller 130. Also, the outer surface of the conveying roller 150 is surrounded by a friction member 151.

Meanwhile, an idle roller 156 is spaced apart outwardly from the conveying roller 150 by a predetermined gap so that the paper is engaged between the conveying roller 150 and the idle roller 156. A shaft 152 of the conveying roller 150 is placed movably in an internal guide 154 in which a long slit 154*a* is formed.

Figure 3:
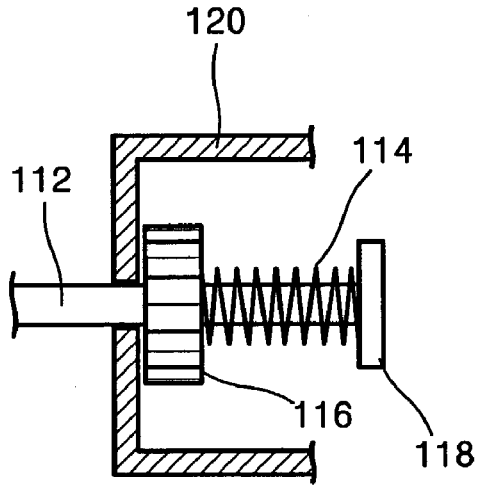
FIG. 3 is a partial enlarged view of FIG. 2.

FIG. 3 is an enlarged view of a driving gear portion of FIG. 2. Referring to FIG. 3, the driving gear 116, a spring 114, and a spring fixing member 118 from the inside of the gear train housing 120 are sequentially placed on the driving shaft 112.

The spring 114 compresses one side of the driving gear 116 from the spring fixing member 118 to apply a friction force between the other side of the driving gear 116 and an inner surface of the gear train housing 120.

Figure 4A:
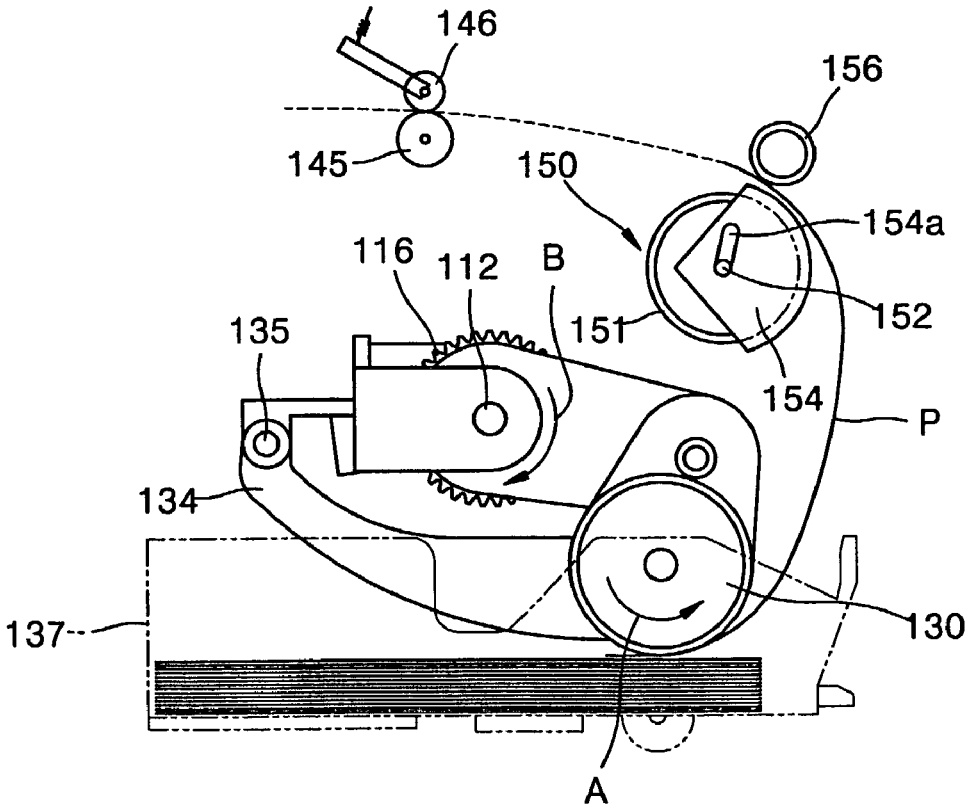
FIGS. 4A through 4C illustrate the operations of the paper feeding apparatus used with a printer according to FIG. 2.
Figure 4B:
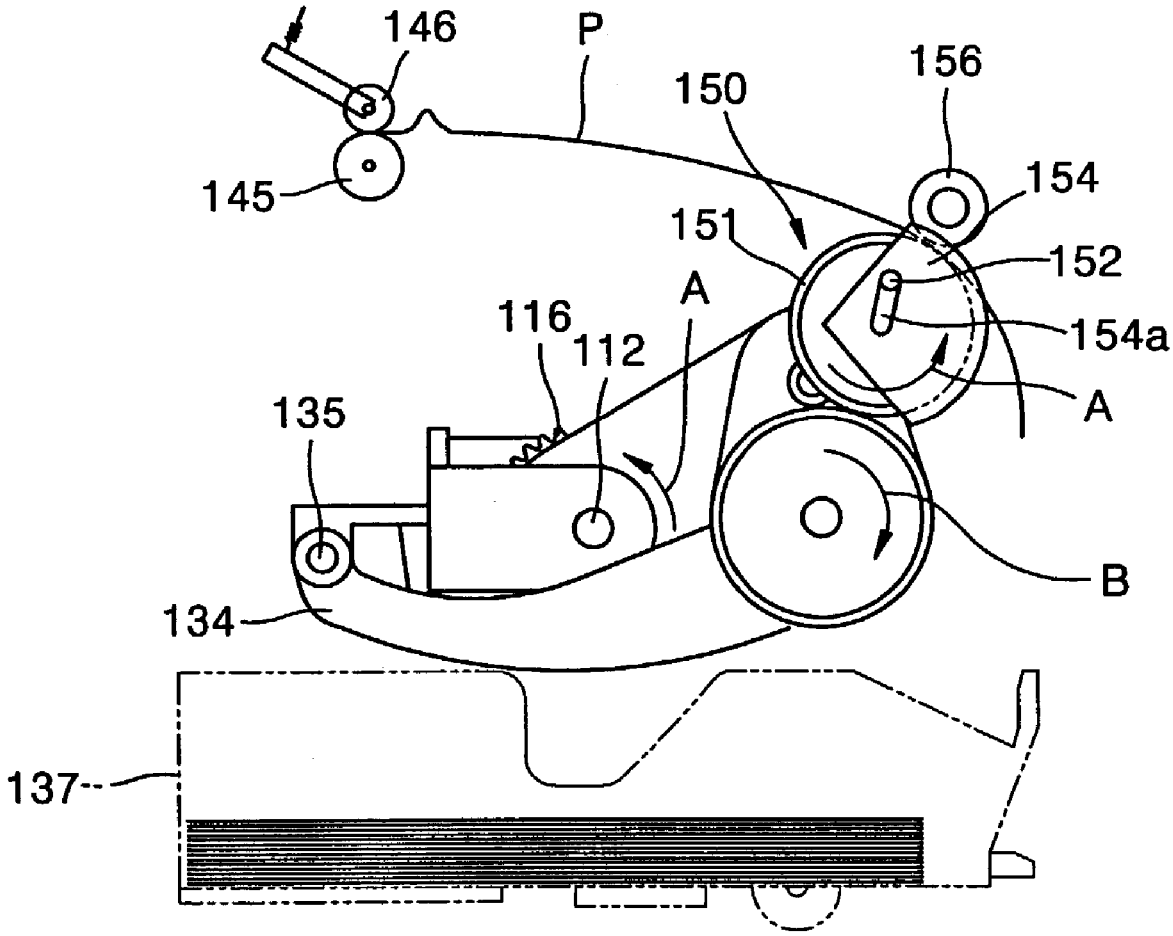
Figure 4C:
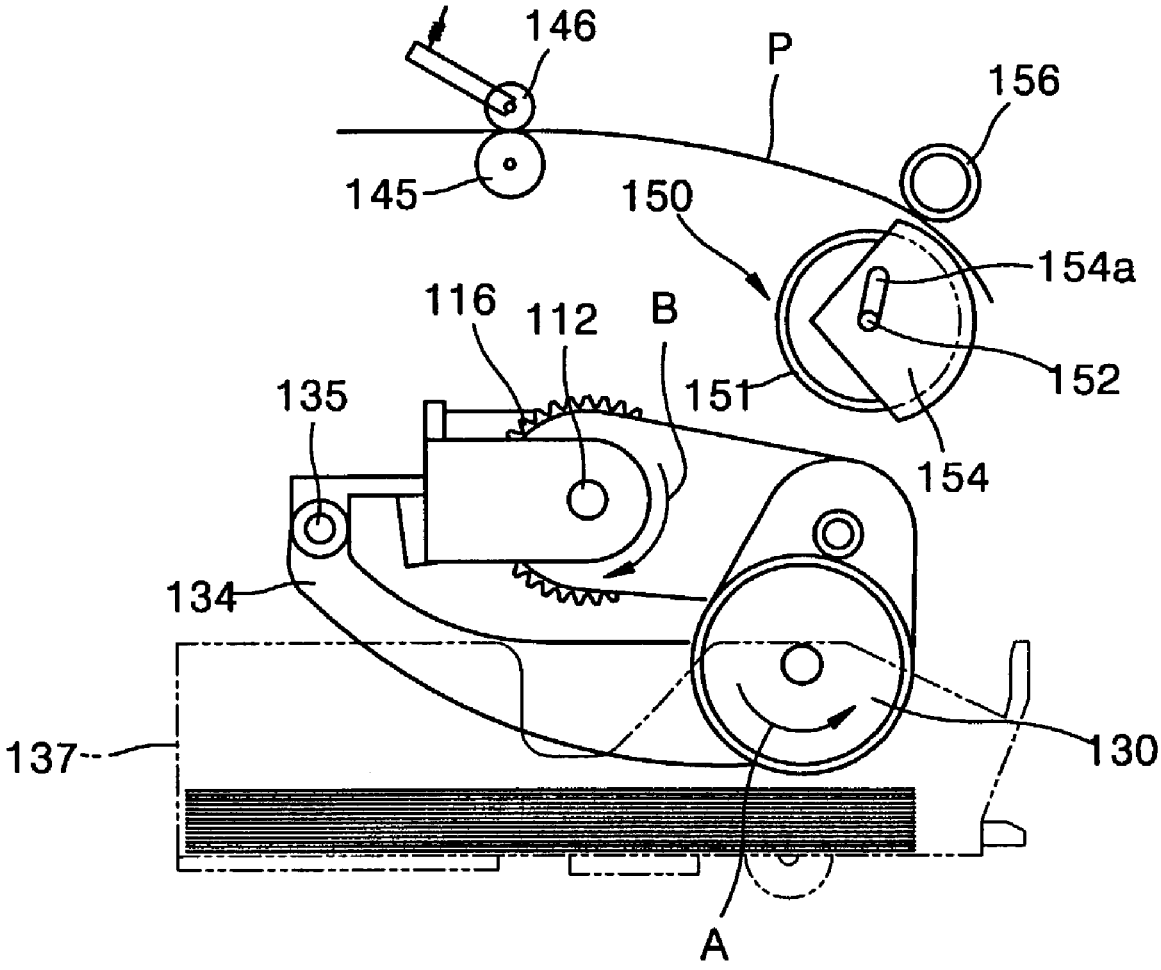

FIGS. 4A through 4C illustrate the operations of the paper feeding apparatus for a printer according to an embodiment of the present invention. The operations of the paper feeding apparatus for a printer having the above structure will be described in detail with reference to FIGS. 4A through 4C.

Drawing out a printing paper stacked in a cassette using a pickup roller 130 and conveying the drawn-out paper to a conveying roller 150 will be described first.

When a printer operates, the driving shaft 112 and the driving gear 116 rotate in a direction B indicated of FIG. 4, by rotation of the driving motor 110 of the paper feeding apparatus 100. The two relay gears 117*a* and 117*b* are driven and rotated by rotation of the driving gear 116, and the pickup roller gear 119 and the pickup roller 130 are driven and rotated in a direction A opposite to a rotation direction of the driving gear 116. The pickup roller 130, connected to the support arm 134, draws out a sheet of paper and conveys the paper onto a paper feeding route by rotation in the direction A, while pressing the paper P in the cassette 137 centering on the pivot axis 135 by the weight of the pickup roller 130. In this case, one end of the paper is fed between the conveying roller 150 spaced apart from the idle roller 156 fixed in the printer by a predetermined distance, and the idle roller 156. In this case, the driving motor 110 applies a force in the direction B centering on the driving shaft 112, and a friction force generated by the spring 114 is applied in a direction of an axis of the driving shaft 112, such that the sum of the forces downwardly acts centering on the driving shaft 112. Thus, the pickup roller 130 contacts the paper of the cassette 137 and is spaced apart from the conveying roller 150 by a predetermined distance, as shown in FIG. 4A.

Subsequently, pivoting the gear train housing 120 and the pickup roller 130 centering on the driving shaft 112 and the pivot axis 135, respectively and conveying the paper fed between the conveying roller 150 and the idle roller 156 by the pickup roller 130, to a next printing route will be described.

If the driving motor 110 inversely rotates in a state when one end of the paper is positioned between the conveying roller 150 and the idle roller 156, the driving shaft 112 and the driving gear 116 rotate in the direction A, as shown in FIG. 4B. Thus, the pickup roller 130 rotates in the direction B opposite to the rotation direction of the driving shaft 112. In this case, the sum of the friction force applied in the longitudinal direction of the driving shaft 112 generated by the spring 114 and the force of the driving shaft 112 applied in the direction A upwardly acts. If the sum of the forces is greater than the weight of a pivoting portion including the gear train housing 120 in which the driving shaft 112 serves as a pivot axis and the pickup roller 130, the pivoting portion pivots to go up centering on the driving shaft 112 and the pivot axis 135. The moved-up pickup roller 130 pushes up the conveying roller 150 and rotates the conveying roller 150 in the direction A opposite to the rotation direction of the pickup roller 130. The shaft 152 of the conveying roller 150 goes up along the long slit 154*a* formed in the internal guide 154 fixed in the printer, and the conveying roller 150 contacts the idle roller 156, conveys the paper P placed between the internal guide 154 and the idle roller 156 in the paper feeding route such that the paper passes the conveying roller 150 (see FIG. 4B). Subsequently, one side of the paper passing the conveying roller 150 contacts a stopped feeding roller 145 and a pinch roller 146. Subsequently, the other side of the paper contacts the feeding roller 145 by rotation of the rotating conveying roller 150 such that the paper is aligned in front of the stopped feeding roller 145. In this case, curl is formed on a part of the paper.

Next, separating the conveying roller 150 from the idle roller 156 when the feeding roller 145 is driven will be described below.

If the feeding roller 145 starts to rotate and feeds the conveyed paper, and simultaneously the driving motor 110 of the paper feeding apparatus 100 rotates in the direction B, the sum of a rotation force of the driving shaft 112 and a friction force generated by the spring 114 downwardly acts such that the gear train housing 120 and the pickup roller 130 go down. As such, a force applied to the conveying roller 150 is removed such that the shaft 152 of the conveying roller 150 goes down along the long slit 154*a* formed in the internal guide 154 and is isolated from the paper feeding route (see FIG. 4C). Thus, the paper fed to the feeding roller 145 is fed to the printing portion at a predetermined speed by the force of the feeding roller 145, and thus the above-mentioned white printing does not occur.

As described above, in the paper feeding apparatus for a printer according to the present invention, the conveying roller is rotated only when the conveying roller is needed to be driven and is isolated from a paper feeding route so that a sheet of paper aligned by the feeding roller is fed only by the feeding force of the feeding roller and is not affected by a curl. Thus, printing quality can be improved.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A paper feeding apparatus for a printer, the printer including a paper feeding route, the apparatus comprising:

a pivoting support arm supporting a pickup roller which draws out a paper stacked in a cassette and conveys the paper to the printer, wherein the pickup roller is rotated by a driving motor so that the support arm pivots downwards when the pickup roller rotates in a paper feeding direction and pivots upwards when the pickup roller rotates in a direction that is opposite to the paper feeding direction;

a conveying roller and an idle roller spaced outwardly from the conveying roller by a predetermined gap to convey the drawn-out paper onto the paper feeding route, the paper being engaged between the conveying roller and the idle roller, the conveying roller including a shaft placed movably in an internal guide having a long slit formed therein; and a feeding roller which feeds the paper conveyed by the conveying roller from the paper feeding route to a printing portion, wherein the conveying roller is positioned above the pickup roller, the paper feeding route is positioned above the conveying roller, the conveying roller is pushed upwards and contacts the paper feeding route by a contact with the pickup roller when the pickup roller pivots upward thereby pushing the conveying roller upward in the internal guide, the conveying roller goes down and is isolated from the paper feeding route due to its weight when the pickup roller pivots downward, the conveying roller is driven when the paper supplied by the pickup roller is conveyed to the feeding roller, and after the paper is conveyed to the feeding roller, the conveying roller is isolated from the paper feeding route.

2. The apparatus of claim 1, further comprising:

a driving gear connected to one end of a driving shaft extended from the driving motor for driving the pickup roller;

a pickup roller gear connected to a shaft, the pickup roller being connected to the shaft, which rotates by the driving gear in a direction opposite to a rotation direction of the driving gear; and a gear train housing in which the driving gear and the pickup roller gear are provided.

3. The apparatus of claim 2, wherein a plurality of relay gears are provided between the driving gear and the pickup roller gear.

4. The apparatus of claim 2, wherein a compressing unit rotates with the driving gear and the driving shaft so that one side of the driving gear is closely adhered to an inside of the gear train housing, thereby generating a predetermined friction force in a longitudinal direction of the driving shaft between the gear train housing and the one side of the driving gear.

5. The apparatus of claim 4, wherein the compressing unit is a compression spring, one end of which is fixed in the driving shaft and the other end thereof is closely adhered to an other side of the driving gear such that an elastic force acts in the longitudinal direction of the driving shaft.

* * * * *